US005806219A

United States Patent [19]

Feingold

[11] Patent Number: 5,806,219

[45] Date of Patent: Sep. 15, 1998

[54] DISPLAY DEVICE

[76] Inventor: Norman S. Feingold, 25 Tain Dr., Great Neck, N.Y. 11021

[21] Appl. No.: 797,635

[22] Filed: Feb. 7, 1997

[51] Int. Cl.[6] ..... G09F 11/04

[52] U.S. Cl. ..... 40/435; 40/474; 475/432

[58] Field of Search ..... 40/113, 433, 430, 40/435, 474, 484, 493, 494; 475/330, 331, 332, 337

[56] References Cited

U.S. PATENT DOCUMENTS

| | | |
|---|---|---|
| 489,027 | 1/1893 | McDonald . |
| 751,086 | 2/1904 | Lynn . |
| 1,465,839 | 8/1923 | Carroll . |
| 1,684,534 | 9/1928 | Campbell . |
| 1,707,081 | 3/1929 | Fleak . |
| 1,725,851 | 8/1929 | Craig . |
| 1,822,798 | 9/1931 | Carroll . |
| 1,851,585 | 3/1932 | Kliegl . |
| 2,082,612 | 6/1937 | Bourquin . |
| 2,205,937 | 6/1940 | Sullivan . |
| 2,360,536 | 10/1944 | Avery . |
| 2,512,465 | 6/1950 | Moorhouse . |
| 2,527,803 | 10/1950 | Fleak . |
| 2,586,641 | 2/1952 | Gabrielsen . |
| 2,831,580 | 4/1958 | Carbone . |
| 3,050,888 | 8/1962 | Myers et al. . |
| 3,155,430 | 11/1964 | Schindler . |
| 3,545,113 | 12/1970 | Babberl . |
| 3,562,936 | 2/1971 | Schoenung . |
| 3,755,936 | 9/1973 | Terre et al. . |
| 3,846,926 | 11/1974 | Sullivan ..... 40/435 X |
| 5,088,969 | 2/1992 | Arndt ..... 475/332 X |
| 5,134,795 | 8/1992 | Wang . |

*Primary Examiner*—Cassandra H. Davis

[57] ABSTRACT

A display device consisting of a plurality of rotating segments each carrying elements of a message or sign, each rotating relative to each other, the center of rotation of each being contained within the circumference of its adjacent segment, either eccentrically or concentrically. These segments are driven by a series of planetary gear systems or their equivalent, arranged in layers, each driving the next. To these segments may be attached a plurality of auxiliary devices, all driven by the same mechanism, which can enhance the attraction of the device, carry elements of the message, etc. Each segment or auxiliary device can be of a variety of shapes, colors, graphics, etc. Segments can be nested or overlapping, totally or in combination. Message can be continuously or intermittently scrambled and unscrambled.

1 Claim, 13 Drawing Sheets

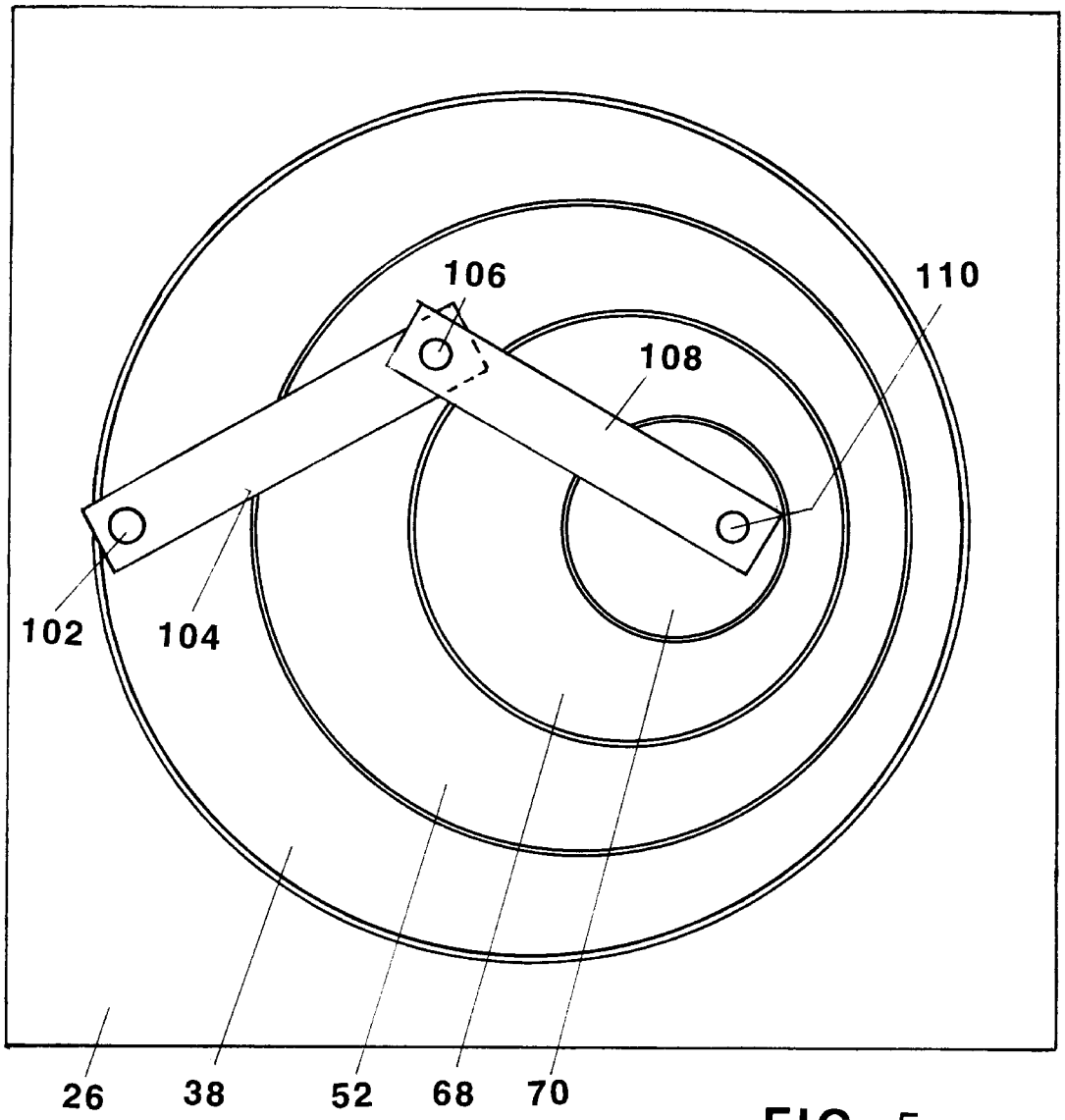
FIG. 5
FIG. 6
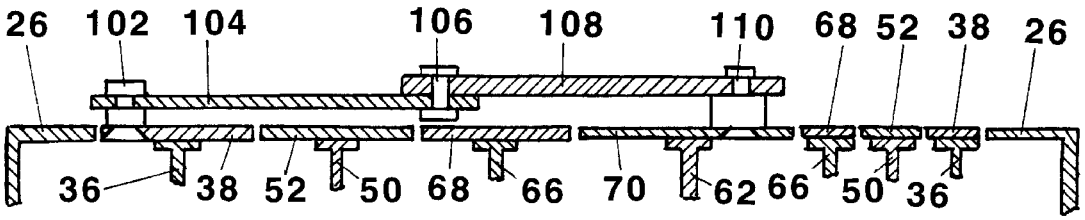

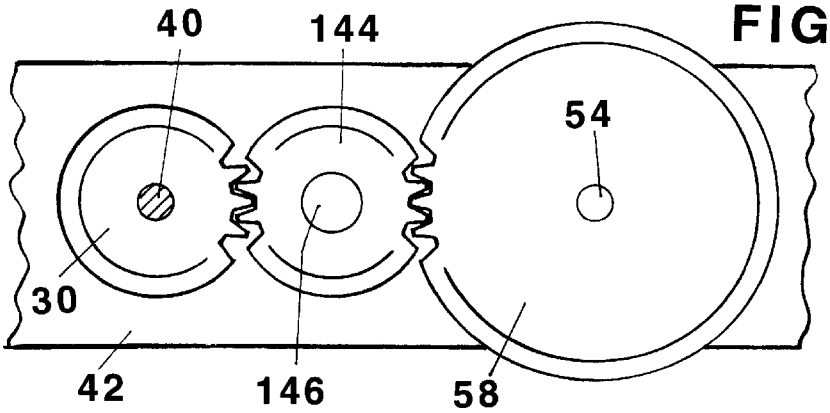
FIG. 11
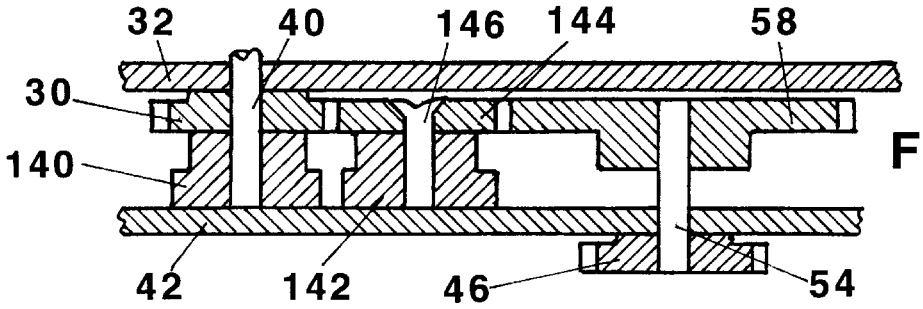
FIG. 12
FIG. 13
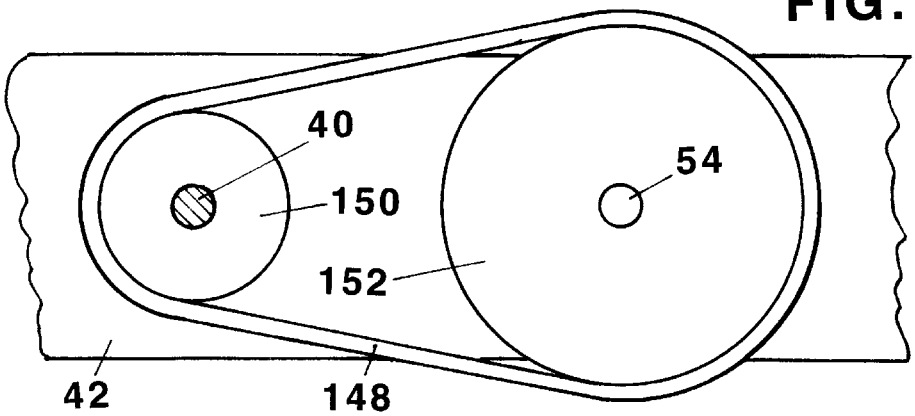
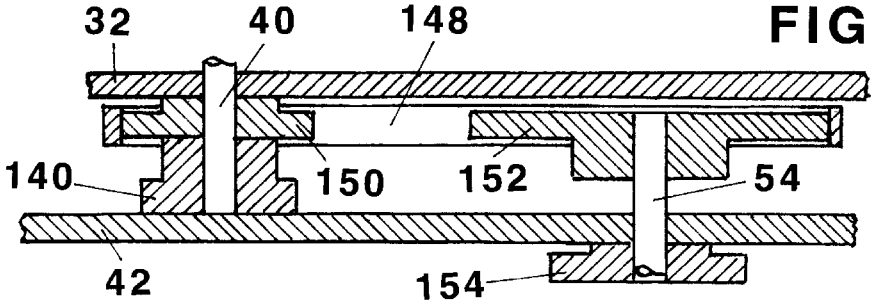
FIG. 14

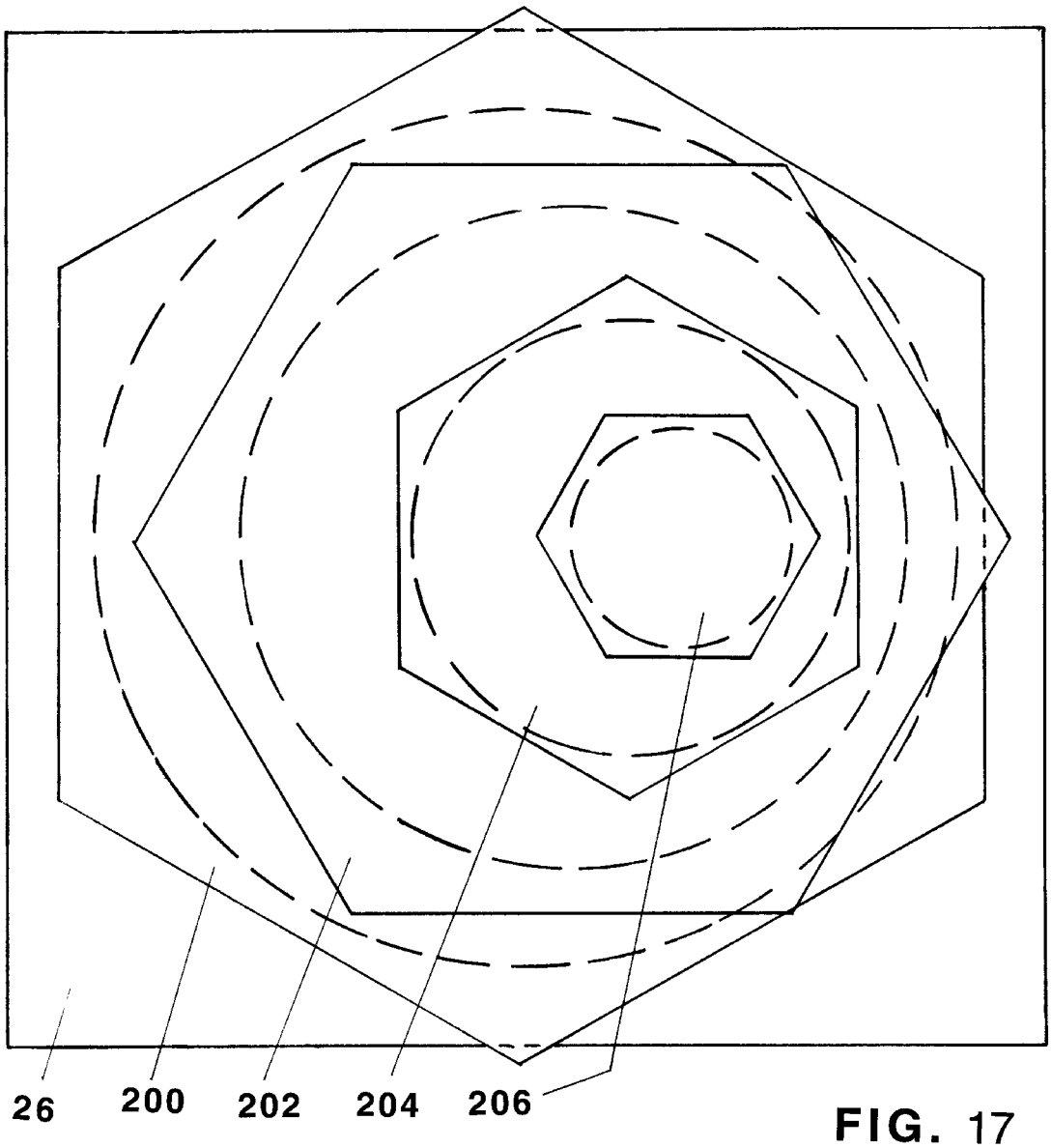
FIG. 17
FIG. 18
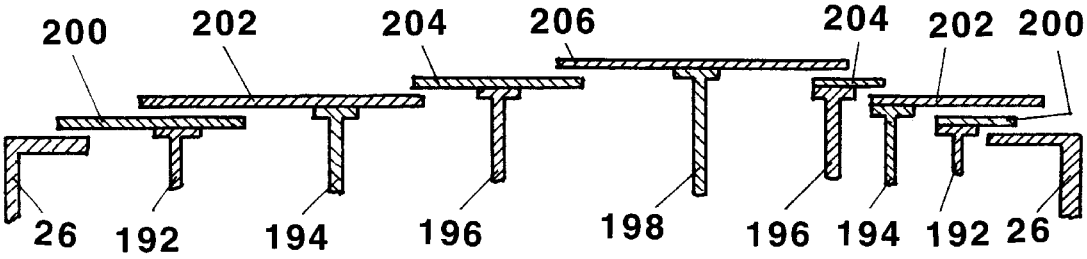

DISPLAY DEVICE

BACKGROUND

1. Field of Invention

The effectiveness of a mechanical display device, when used for signs or advertising, is determined in part by its ability to attract attention. This invention relates to a display device in which various basic and auxiliary segments move in relation to one another causing attraction to images of various messages, shapes, designs and colors.

2. Discussion of Prior Art

There are many previous attempts to achieve eye-catching display devices through the use of mechanically driven (usually powered by an electrical motor) segments, usually arranged equidistant from a center, using color, motion, transparent discs, masking and unmasking the display. Some of these are effective in attracting attention, but most are complicated in design, costly to build and of limited effectiveness. Several clock designs are referenced, but these are very limited in their appeal, being basically clocks with an added segment. The Babberl patent achieves the eye-catching objective by scrambling and unscrambling, but is also very limited in scope.

OBJECTS AND ADVANTAGES

Accordingly, several objects and advantages of my invention are to achieve a high degree of attraction to the display by a maximum use of movement, shapes, color, etc. and the ability to scramble and unscramble the segments of the display continuously or intermittently; to allow the use of many auxiliary segments in a variety of ways, to enhance its attraction; and to accomplish this with a single mechanism in a cost effective manner. This invention achieves these objectives with a minimum of mechanism used to create high levels of colorful movement. The result, with or without the optional movements, is a low cost method to attract the desired level of attention.

All segments of the display can be in substantially the same focal plane so that an observer may view the display without additional effort. However, each segment can be in its own plane to achieve other desired effects.

Applications can include advertising messages (single or multiple modules), clocks, point of purchase and window displays (where the products are the message), games, toys as well as educational material. There are also a multitude of artistic and decorative effects for which this device can be used.

The invention possesses other objects and features of advantage which, together with foregoing, will be specifically pointed out in the detailed description of the invention in conjunction with illustrative accompanying drawings hereunto annexed. It is to be understood that the invention is not to be limited to the specific form herein shown and described as various other embodiments thereof may be employed within the scope of the appended claims.

DESCRIPTION

This is a description of a family of mechanical devices consisting of a multiple of planetary gear systems, or equivalent, arranged in tandem (in layers) each driving subsequent ones, to produce dependent but controllable motions in a multiple of rotating display segments. The components of a simple planetary drive consists of fixed gear, driver and follower.

The rotating display segments, each rotated by a corresponding gear system, can be eccentric to each other, concentric to each other or a combination of both, if desired. Segments can be nested, one inside each other, or overlapping, one behind the other.

Each segment carries a part of the message in appropriate color and graphics. The mechanism is driven by a power source, usually an electric motor, continuously or intermittently, forward and or reversing. This movement rotates each segment individually scrambling and unscrambling the message or display. Thus a variety of effects of the displayed scrambling or alignment can be achieved.

Since the primary function of a display device is to draw attention to itself and it's message, and since eccentricity creates additional and more eye catching motions, the preferred configuration is the eccentric mode.

More than one display device can be used in any installation. These can be synchronized, mechanically or electrically, or not, depending upon the nature of the effect desired. Each can have its own mode, i.e. continuous, intermittent, reversing, etc.

The drawings and detailed description depict a five layer system. More than five layers can be used. The minimum is three layers with two moving layers.

Center to center distance between fixed gears and projecting shafts with followers can be controlled to achieve nesting of above mentioned segments in the same plane, if desired. (Rotating in the same plane) It may be desirable to have machine segments rotate in different planes, described later as overlapping segments, and not rotate in the confines of it's adjacent segments.

This device can be driven by an outside source such as an electrical motor. Solenoids, pneumatic cylinders, etc. may be substituted in some applications, especially where partial revolutions or repetitive partial revolutions are required. Hand power, through a crank, is applicable in some applications.

Gears can consist of a multiple of ratios and can i ncorporate idlers. Together a wide variety of individual relative speeds and individual directions of rotation can be achieved. Also, pulleys and belts or timing gears and timing belts can be used, eliminating the need for idlers. The minimum speed ratio between adjacent segments without the use of idlers or belts is slightly more than 1. Using idlers or belts allows for speed ratios between adjacent segments of less than 1 and 1, and al so allows for a change in direction.

The plate supporting the gears and the bearings supporting the rotating shafts is connected to the rotating segments by brackets. There may be two or more brackets, or a truncated cone or cylinder depending upon the application.

Pulleys may be added between rotating segments and in contact with these segments. These pulleys will rotate about their own axes as well as the axes of the segments in contact. The speed of rotation as well as the direction of rotation (clockwise or counter-clockwise) about each axis, will depend upon the relative diameters of the pulley and the contact diameters of the adjacent segments, as well as the speed of rotation of the two segments, and the direction of rotation.

These pulleys will be attached to an annular ring for support and to maintain fixed locations relative to one another, insuring support of the segments. This annular ring rotates relative to the segments.

Thus, two additional segments of movement can be added to the display when desired. Any combination of pulleys, with or without plates, annular rings or nothing can be used in any combination.

Also, these pulleys can provide support, if necessary, in applications where the segments are heavy, or support outboard weights. This support can also be achieved by the use of balls between the segments as will be shown.

Also, this surface may support three dimensional projections in a wide variety of configuration. These may also support a variety of kinematic segments, (levers, cranks, links, plungers, gears, cams, etc.), as shown in the drawings and accompanying description, interacting with two or more segments to achieve a prescribed motion.

The outer surface of the rotating segments, as well as the plates on pulleys, annular rings, links, etc., may have printed material, graphics or painting to achieve the desired effect.

Thus, a variety of auxiliary motions and segments can be added to the display device, with a wide variety of motions, shapes and color. These can hide, enhance, spotlight, reveal, emphasize, etc. the intended message or visual image. There can be a multiple of these links, etc. operating at the same time if care is exercised in the design to avoid interference.

Thus, a series of eccentric circles are created which can be used, as adapted, in a variety of ways, impressions and motions.

Overlapping segments can be used in place of nested segments and can be of any shape and size, limited only by the desire to cover any gaps in the previous layer.

Thus additional configurations and eye-catching elements can be added to the device.

All the additional segments described above and in the drawing and description, with reference to the eccentric mode; apply to the concentric mode. The addition of idler gears and the substitution of pulleys for idlers also apply.

The movement generated by the eccentric mode, with or without the additional segments described, nested or overlapping generate more movement and is therefore preferred in most applications.

BRIEF DESCRIPTION OF DRAWINGS

FIG. 5 is a view of parallel links added to the device.

FIG. 6 is a sectional view through FIG. 5.

FIG. 11 is a partial view of a nested display device with an idler added to the device for a larger range of speed of rotation and reversal of direction.

FIG. 12 is a sectional view of FIG. 11.

FIG. 13 is a partial view of a nested display device with a belt drive added to the device for a larger range of speed of rotation and reversal of direction.

FIG. 14 is a sectional view of FIG. 13.

FIG. 17 is an elevation view of an overlapping display device with eccentric rotating members.

FIG. 18 is a partial sectional view through FIG. 17.

DETAILED DESCRIPTION OF THE DRAWINGS

Figure 1:
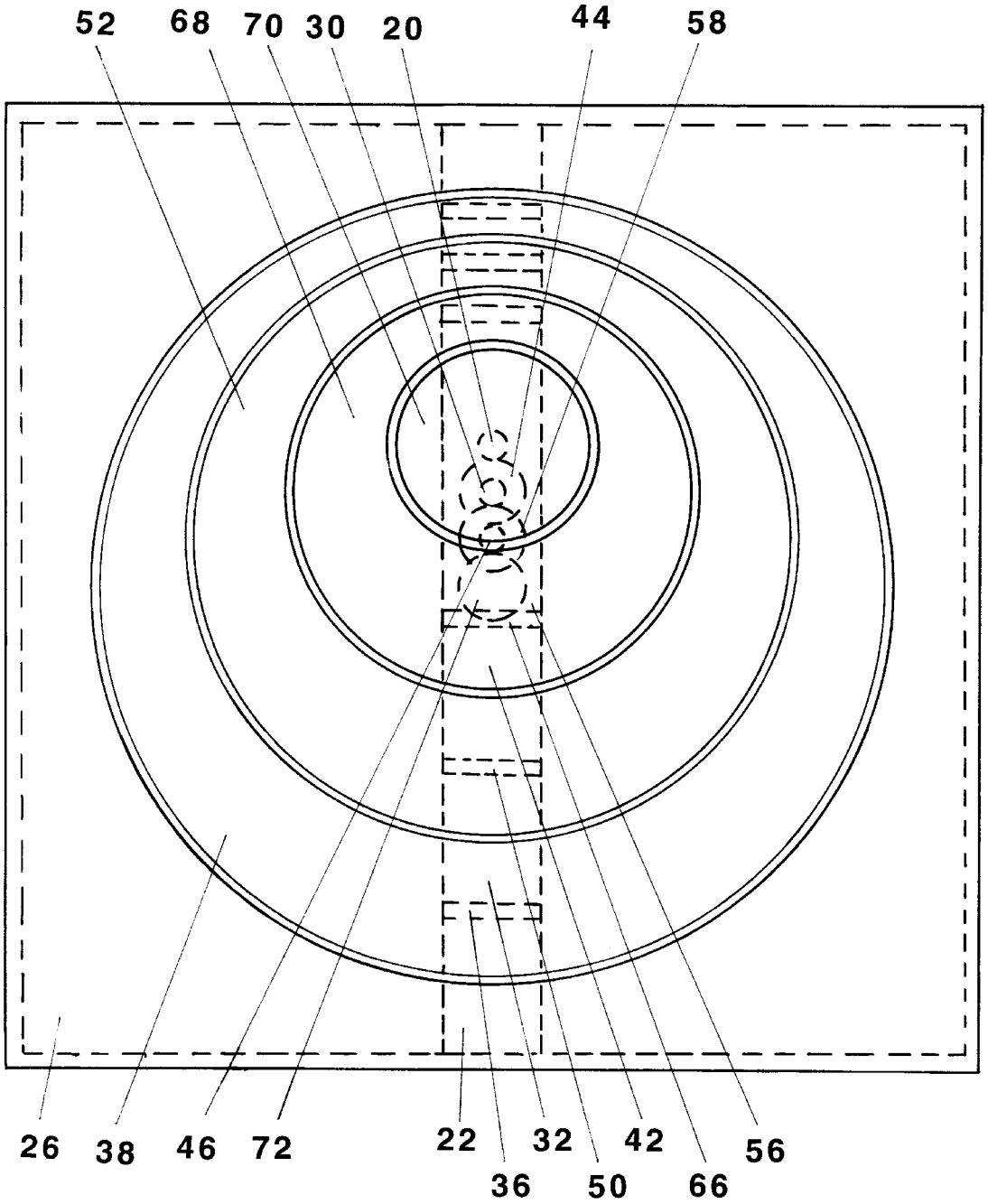
FIG. 1 is an elevation view of a display device with nested eccentric rotating segments.
Figure 2:
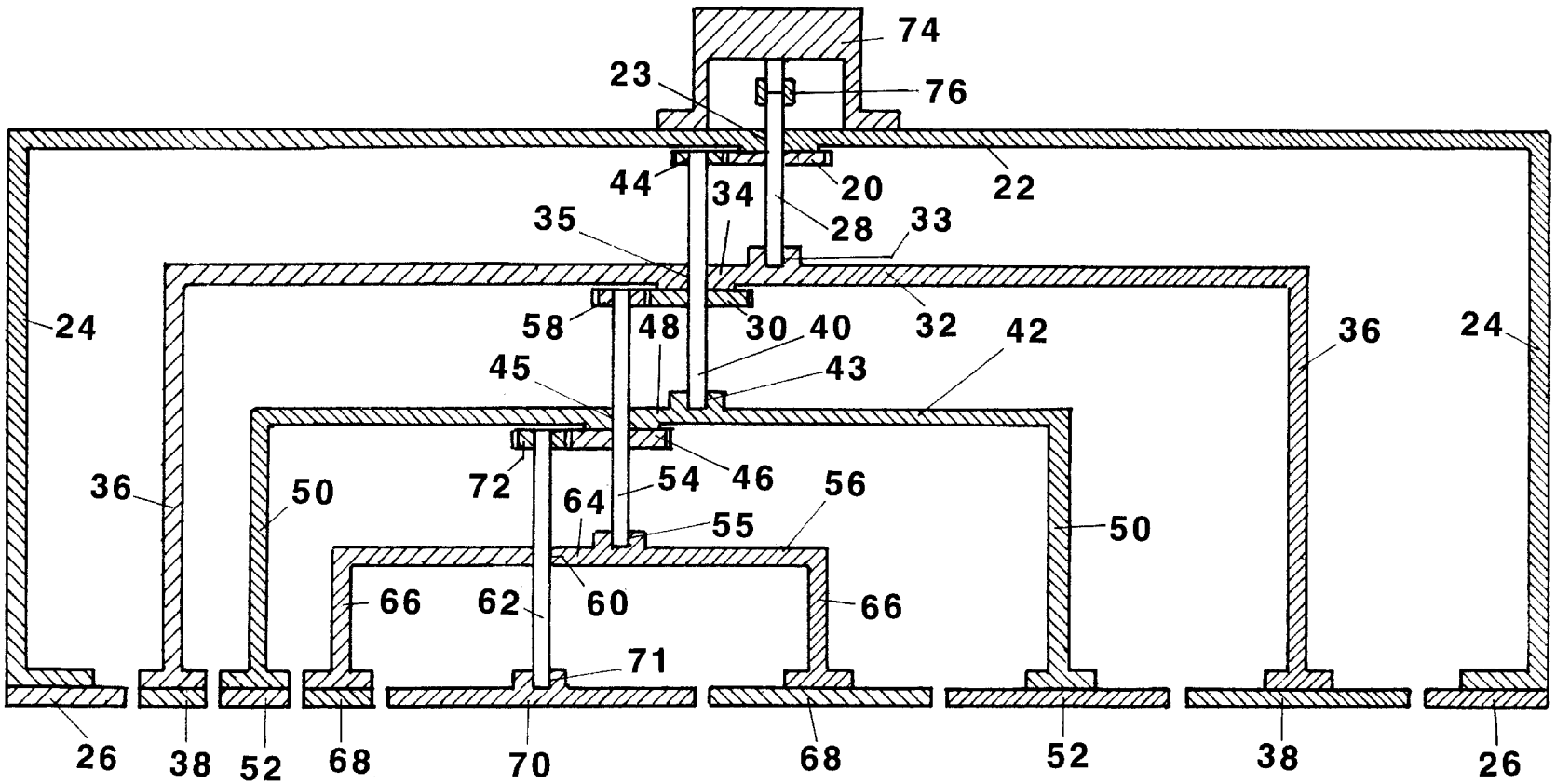
FIG. 2 is a sectional view through FIG. 1.

In a five layer system, as shown in FIG. 1 and FIG. 2, the first layer is stationary and contains a fixed gear 20 only, mounted on the side of a plate 22 nearest the second layer, with a bracket 24, supporting a stationary segment 26. Plate 20, bracket 24 and stationary segment 26 can be a part of device housing.

The second layer is rotated by a drive shaft 28 concentric with fixed gear 20 on the first layer, and passing through it. The second layer also contains a fixed gear 30 on the side of a plate 32 nearest the third layer. The distance between drive shaft 28 and the center of fixed gear 30 becomes a driver 34. A bracket 36 emanating from both ends of plate 32 supports a rotating segment 38.

The third layer has a projecting shaft 40, from a plate 42, on which is mounted a follower 44. Shaft 40 goes through fixed gear 30 on the second layer and is concentric to gear 30. Follower 44 meshes (sometimes through an idler) with fixed gear 20 on the first layer. As the second layer rotates, the third layer is rotated. The third layer also contains a fixed gear 46 on the side of plate 42 nearest the fourth layer. The distance between drive shaft 40 and the center of fixed gear 46 becomes a driver 48. A bracket 50 emanating from both ends of plate 42 supports a rotating segment 52.

The fourth layer has a projecting shaft 54, from a plate 56, on which is mounted a follower 58. Shaft 54 goes through fixed gear 46 on the second layer and is concentric to gear 46. Follower 58 meshes (sometimes through an idler) with fixed gear 30 on the second layer. As the third layer rotates, the fourth layer is rotated. The fourth layer does not contain a fixed gear on its side nearest the fifth layer. It does, however contain a hole 60 through which a projecting shaft 62 from the fifth layer passes. The distance between hole 60 and the shaft 54 projecting from the fourth layer becomes a driver 64. A bracket 66 emanating from both ends of plate 56 supports a rotating segment 68.

The fifth layer has projecting shaft 62, on a rotating segment 70, on which is mounted a follower 72. Shaft 62 goes through hole 60 in the fourth layer. Follower 72 meshes (sometimes through an idler) with fixed gear 46 on the third layer. As the fourth layer rotates, the fifth layer is rotated. There are no brackets in this layer in most applications. However, there are some applications in which the plate is separate from the segment and brackets are required. (Applications where the segments are not in the same plane.)

A motor 74 or any other driving device is connected to shaft 28 by a coupling 76.

Thus fixed gear 20, driver 34 and follower 44 become a planetary gear system. Similarly, fixed gear 30, driver 48 and follower 58, and fixed gear 46, driver 64 and follower 72 become planetary gear systems.

Figure 1A:
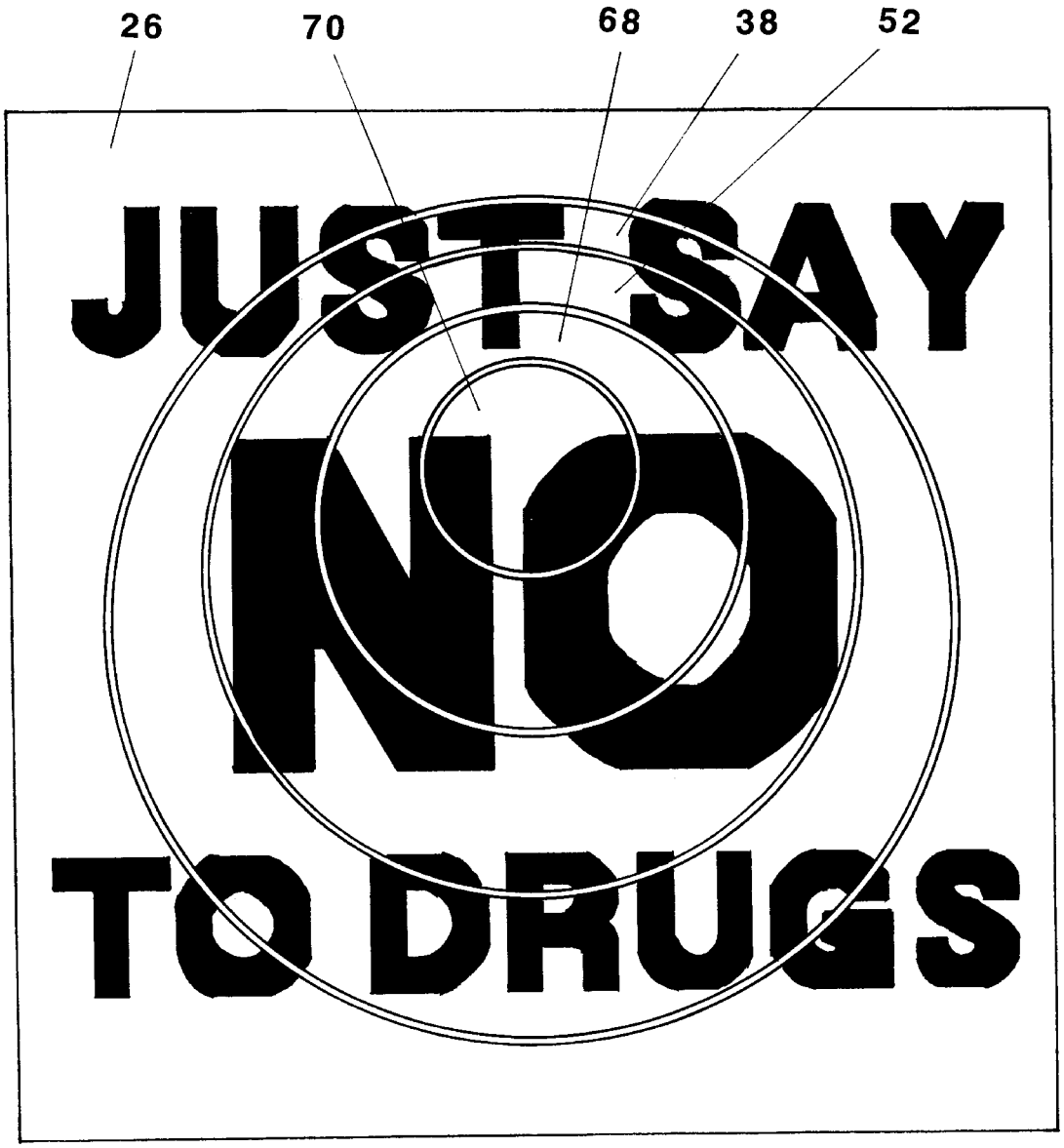
FIG. 1A is the display device with nested eccentric rotating segments containing a message.

FIG. 1A shows the display in an aligned position. Stationary segment 26, rotating segments 38, 52, 68 and 70 have their eccentricities in a straight line making the displayed message easily legible.

Figure 1B:
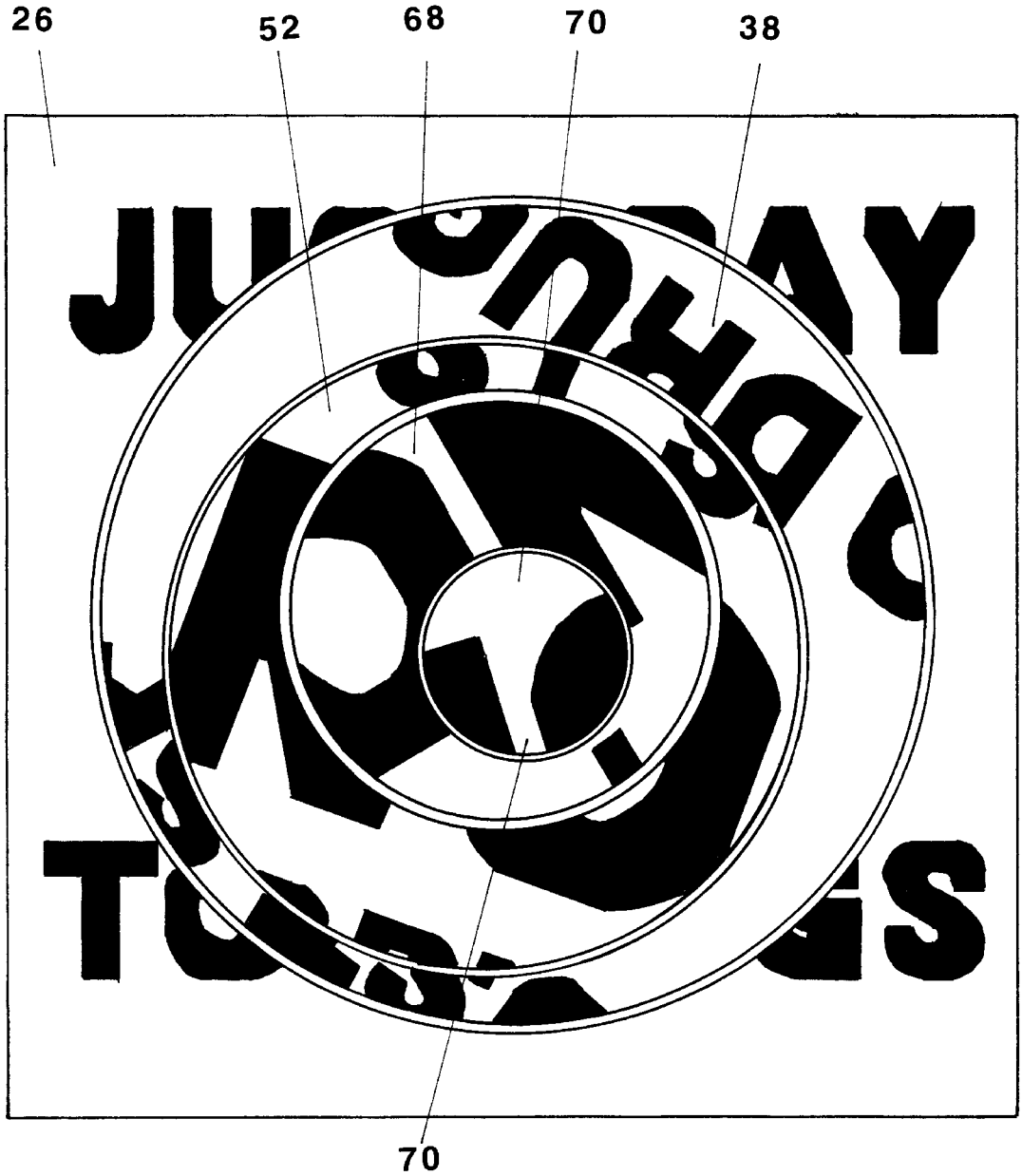
FIG. 1B is the display device with nested eccentric rotating segments containing a scrambled message.

From this position, rotating segments can move in any direction at any relative speed that is designed into the system by choice of gear ratios and use of idlers or pulleys when desired. The ratios and direction are fixed within a design. FIG. 1B shows the same display in a scrambled position. Stationary segment 26, rotating segments 38, 52, 68 and 70 have their eccentricities in a random position making the displayed message not legible.

Figure 4:
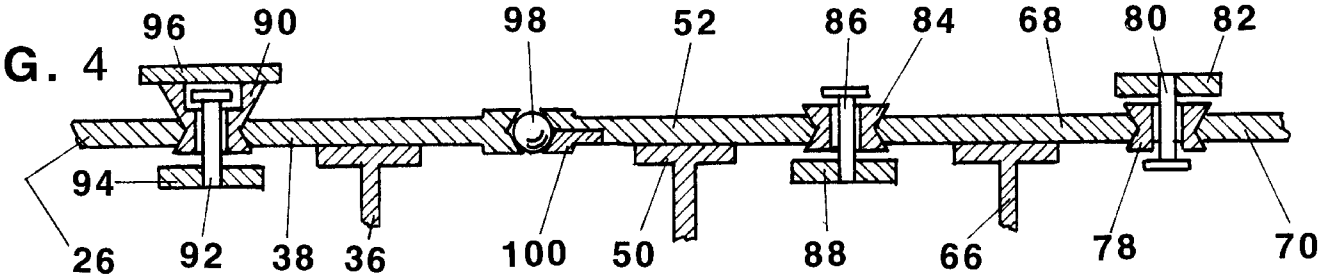
FIG. 4 is a sectional view through FIG. 3.
Figure 3:
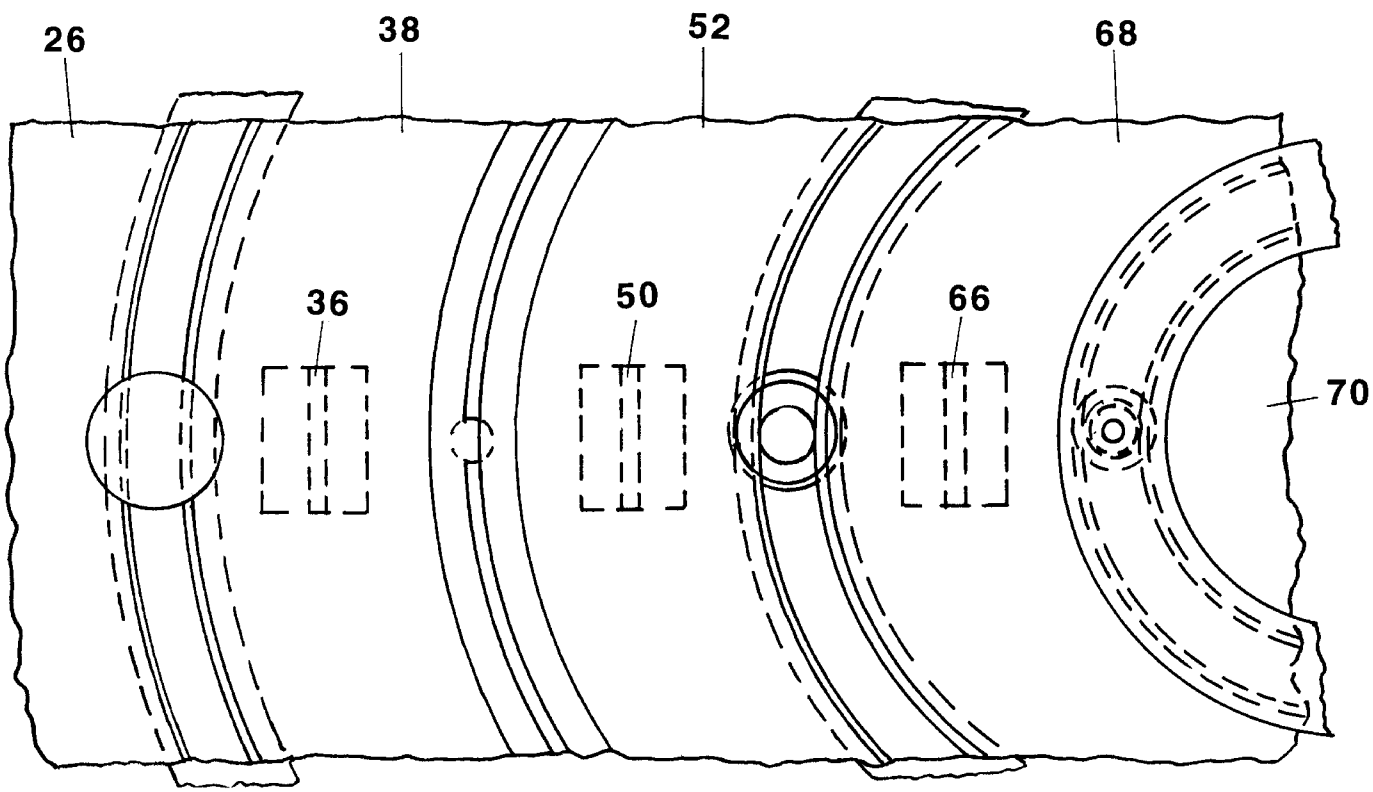
FIG. 3 is a partial view of pulleys, balls and rings added to the device.

In FIG. 3 and FIG. 4, pulleys and balls in a variety of applications described above are shown. A pulley 78, between and in contact with segment 70 and segment 68 rotates about a stud 80 which is attached to an annular ring 82. Annular ring 82 rotates adjacent to the separation between segments 70 and 68 and outside the outer plane of the mechanism.

A pulley 84, between and in contact with segment 52 and segment 68 rotates about a stud 86 which is attached to an annular ring 88. Annular ring 88 rotates adjacent to the separation between segments 68 and 52 and inside the outer plane of the mechanism.

A pulley 90, between and in contact with segment 26 and segment 38 rotates about a stud 92 which is attached to an annular ring 94. Annular ring 94 rotates adjacent to the separation between segments 38 and 26 and inside the outer plane of the mechanism. Attached to pulley 90 is a plate 96 which rotates with pulley 90. Plate 96 can be of any desirable shape and color.

A ball 98, is between and in contact with segment 38 and segment 52. A retainer 100 is attached to segment 52 and is used to allow assembly and retain ball 98.

Another method of adding movement and additional segments to the display device is shown in FIG. 5 and FIG. 6. A link 104, which can be part of the display, pivots around a stud 102 which is fastened to segment 38. Link 104 is connected to a link 108 by means of a pin 106. Link 108 pivots around a stud 110 which is fastened to segment 70. These links operate in a plane parallel to the main plane of the display device. As the segments rotate the distance between stud 110 and stud 102 varies. This variation in center distance forces the links to move angularly around pin 106 and changes the angle between the links.

The studs can be attached to any combination of two segments, on any point of any segment, and the links can be any shape and color. Links 104 and 108 do not have to be the same length, but the effective length of the sum of each length must be long enough to be more than the maximum distance between studs 110 and 102 in all positions of the segments to which they are attached.

Figure 7:
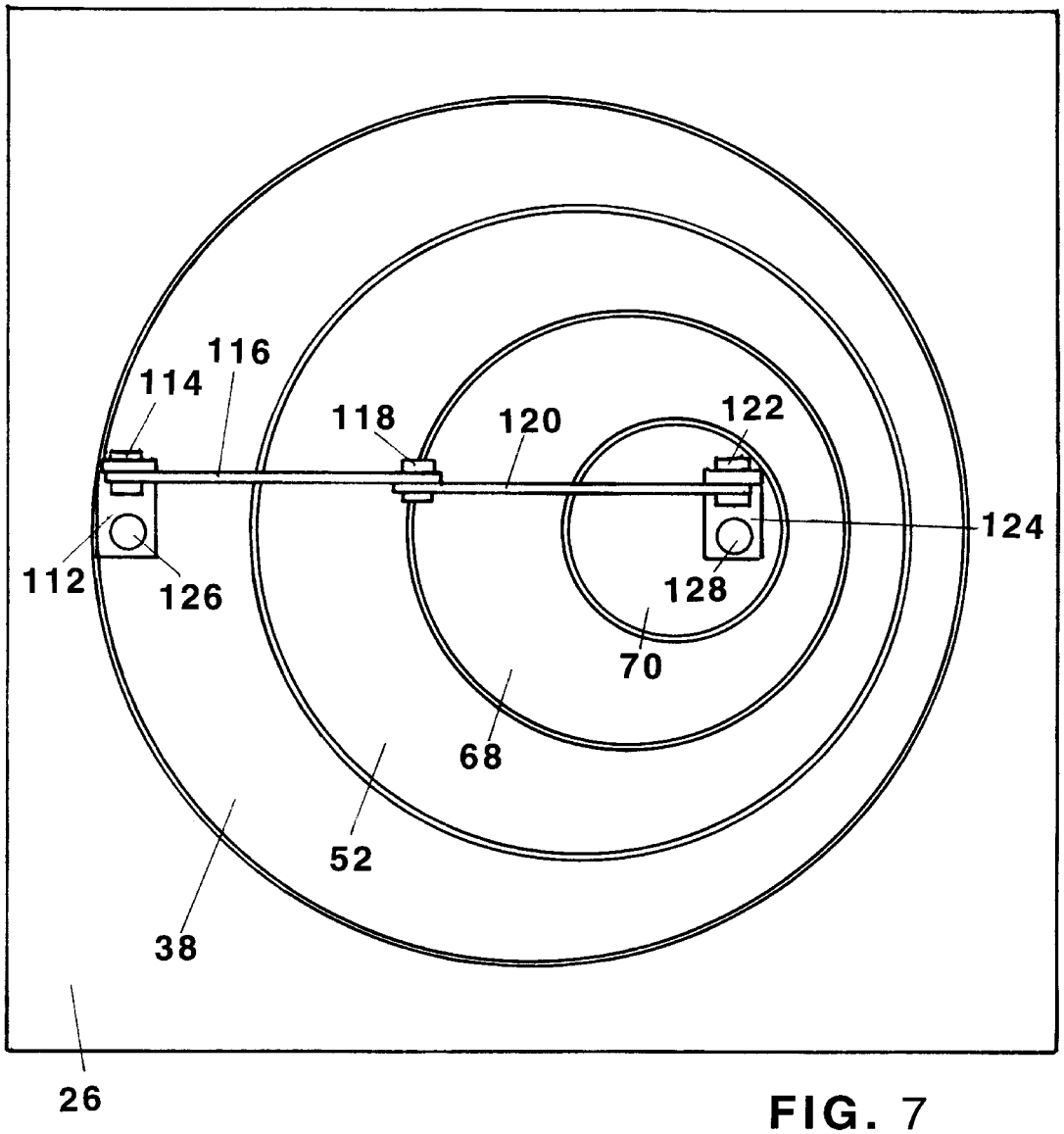
FIG. 7 is a view of perpendicular links added to the device.
Figure 8:
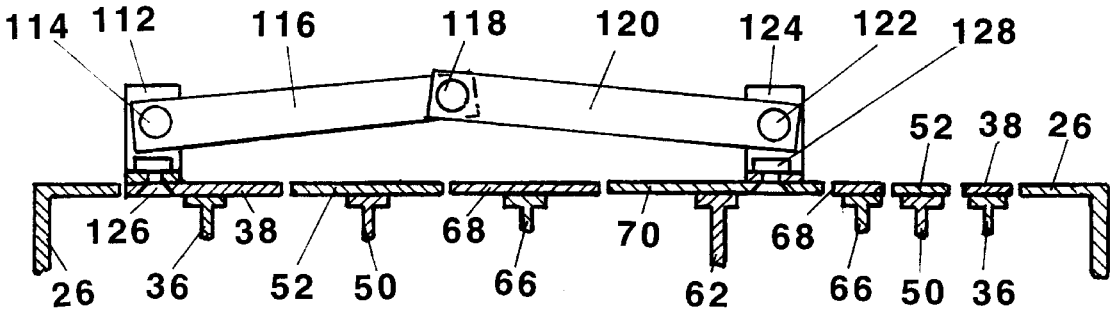
FIG. 8 is a sectional view through FIG. 7.

By switching the links to a plane perpendicular to the main plane of the display device, another method of adding movement and segments to the display device is shown in FIG. 7 and FIG. 8. A link 116 pivots around a pin 114 which is attached to a bracket 112, which in turn is attached to segment 38, by a pin 126. Bracket 112 pivots around pin 126. Link 116 is connected to a link 120 by means of a pin 118. Link 120 pivots around a pin 122 which is fastened to a bracket 124, which in turn is attached to segment 70 by a pin 128. Bracket 124 pivots around pin 128. As the segments rotate, the distance between pin 114 and pin 122 varies. This variation in center distance forces the links to move angularly around pin 118 and changes the angle between the links. This action also causes bracket 112 and bracket 124 to pivot relative to segment 38 and segment 70 to compensate for the changing position of links relative to the plane of the segments.

The pins and brackets may be attached to any combination of two segments, on any point on any segment, and the links can be any shape. Links 116 and 120 do not have to be the same length, but the effective length of the sum of each length must be long enough to be more than the maximum distance between pins 114 and 122 in all positions of the segments to which they are attached.

Figure 9:
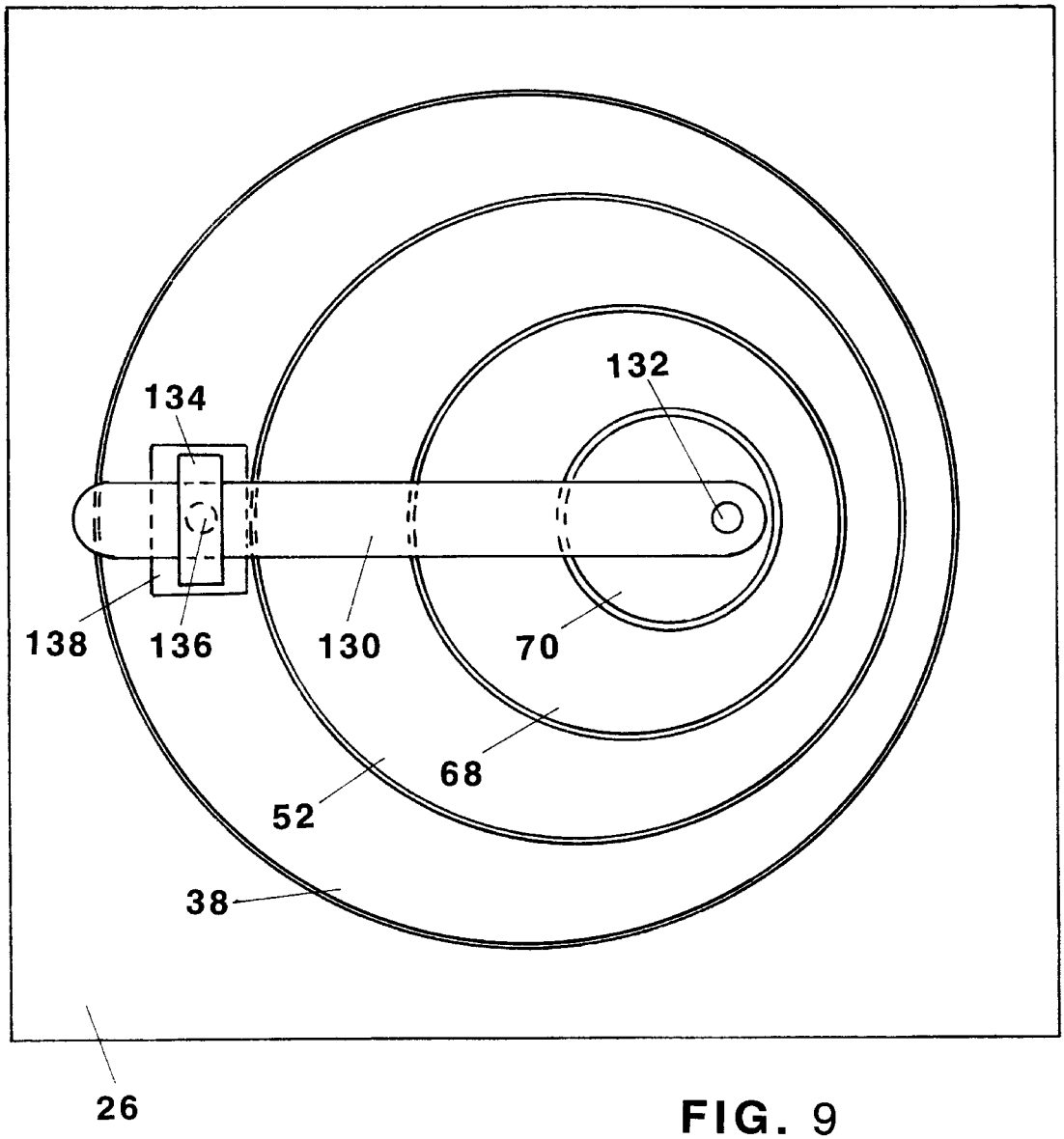
FIG. 9 is a view of a plunger added to the device.
Figure 10:
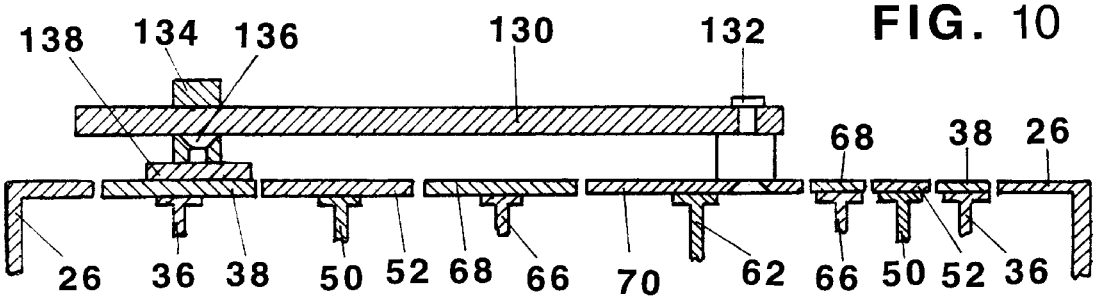
FIG. 10 is a sectional view of FIG. 9.

Another method of adding movement and color through additional segments to the display device is shown in FIG. 9 and FIG. 10. A plunger 130 is attached at one end to segment 70 by means of a stud 132, with plunger 130 pivoting freely around stud 132. The other end of the plunger is contained by and is free to move within the confines of a retainer 134. Retainer 134 is free to pivot around a stud 136 which is attached to a plate 138. Plate 138 is attached to segment 38.

As the segments 38 and 70 rotate, the distance between studs 132 and 136 varies. This variation causes the plunger 130 to move in and out of retainer 134 at a varying angle to stationary segment 26.

The studs can be attached to any combination of two segments, on any point of any segment. The length of plunger 130 shall be long enough to be contained by retainer 134 at the maximum distance between stud 132 and stud 136, in all positions.

Plunger 130 is shown as flat, rectangular in cross-section, with retainer 134 shaped to suit. The shape of plunger 130 in this cross-section can be of any form which will allow the movement desired. Round, square, "I", "T" are a few shapes possible. Retainer 134 can be shaped to suit any of these forms. Also, a variety of shapes, not involved in function, can be attached to plunger 130, by by-passing stud 132 and retainer 134. These shapes can add interest, color, carry messages, etc.

There can be a multiple of any combination of links and plungers operating at the same time, together, if desired with rotating plates and annular rings, provided care is exercised in the design to avoid interference. In FIG. 11 and FIG. 12, showing the use of idlers, fixed gear 30 is attached to plate 32 and does not rotate relative to plate 32. Shaft 40 i s attached to plate 42 by means of a hub 140. Shaft 40 rotates freely within fixed gear 30 and plate 32. A stud 146 is attached to plate 42 by means of a hub 142. An idler gear 144 rotates freely about stud 146 and is prevented from coming off stud 146 by the shape at the end of stud 146. Idler gear 144 meshes with fixed gear 30. Follower gear 58, attached to shaft 54, also meshes with idler gear 144. Shaft 54 rotates freely in plate 42 and fixed gear 46 which is attached to plate 42.

As shaft 40 rotates, plate 42 also rotates. This causes follower gear 58, meshing with fixed gear 30 through idler gear 144, to rotate, also rotating shaft 54.

This change in direction, due to use of idler 144, allows for a wider range of relative speeds, and direction reversal.

FIG. 13 and FIG. 14 show the use of pulleys and a belt instead of an idler. A fixed pulley 150 is attached to plate 32 and does not rotate relative to plate 32. Shaft 40 is attached to plate 42 by means of hub 140. Shaft 40 rotates freely within fixed pulley 150 and plate 32. A follower pulley 152, attached to shaft 54, is driven by fixed pulley 150 through a belt 148. Shaft 54 rotates freely in plate 42 and a fixed pulley 154 which is attached to plate 42.

As shaft 40 rotates, plate 42 also rotates. This causes follower pulley 154, driven by belt 148 from fixed pulley 150 to rotate, also rotating shaft 54.

Figure 15:
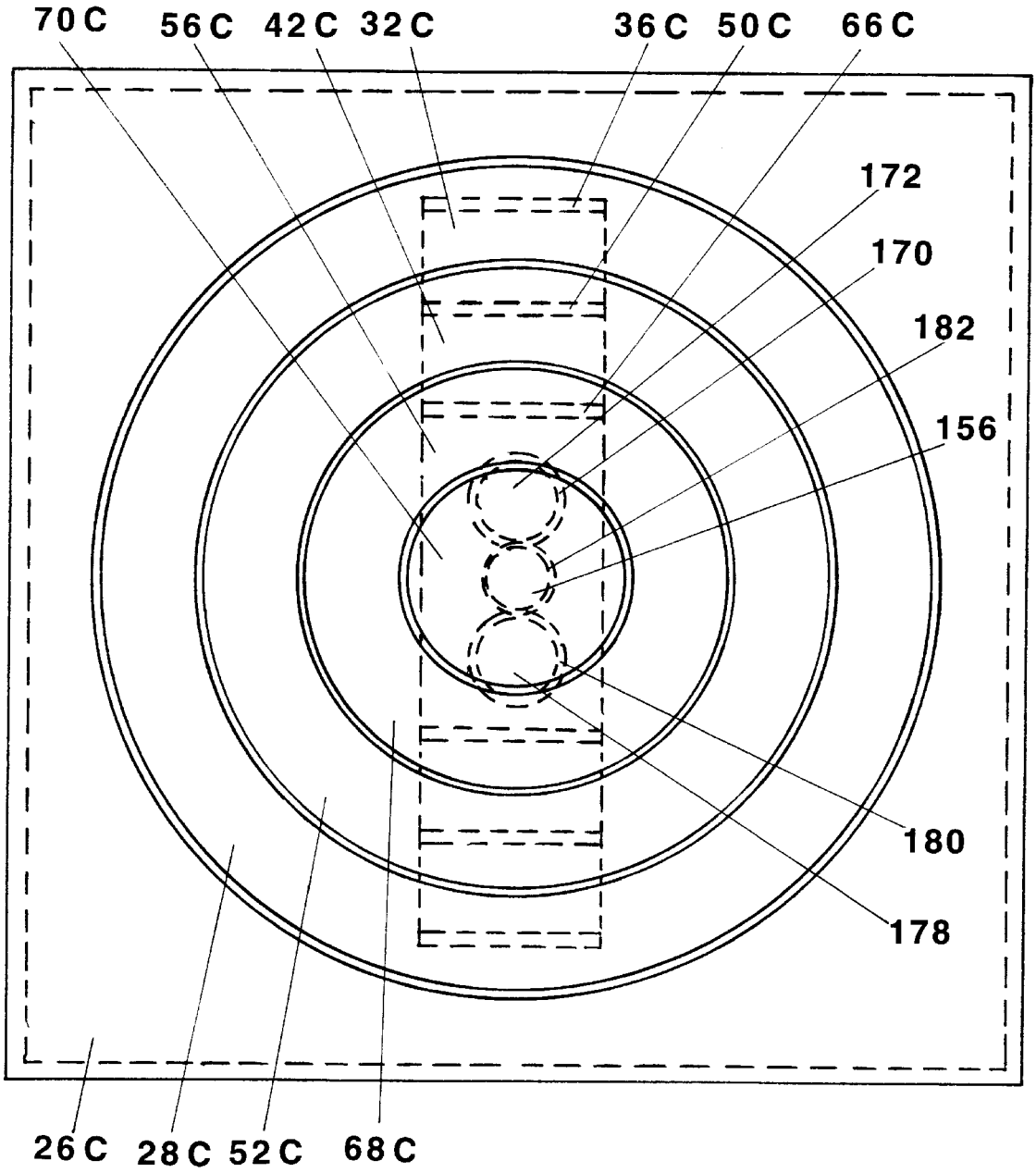
FIG. 15 is an elevation view of a nested display device with concentric rotating segments.
Figure 16:
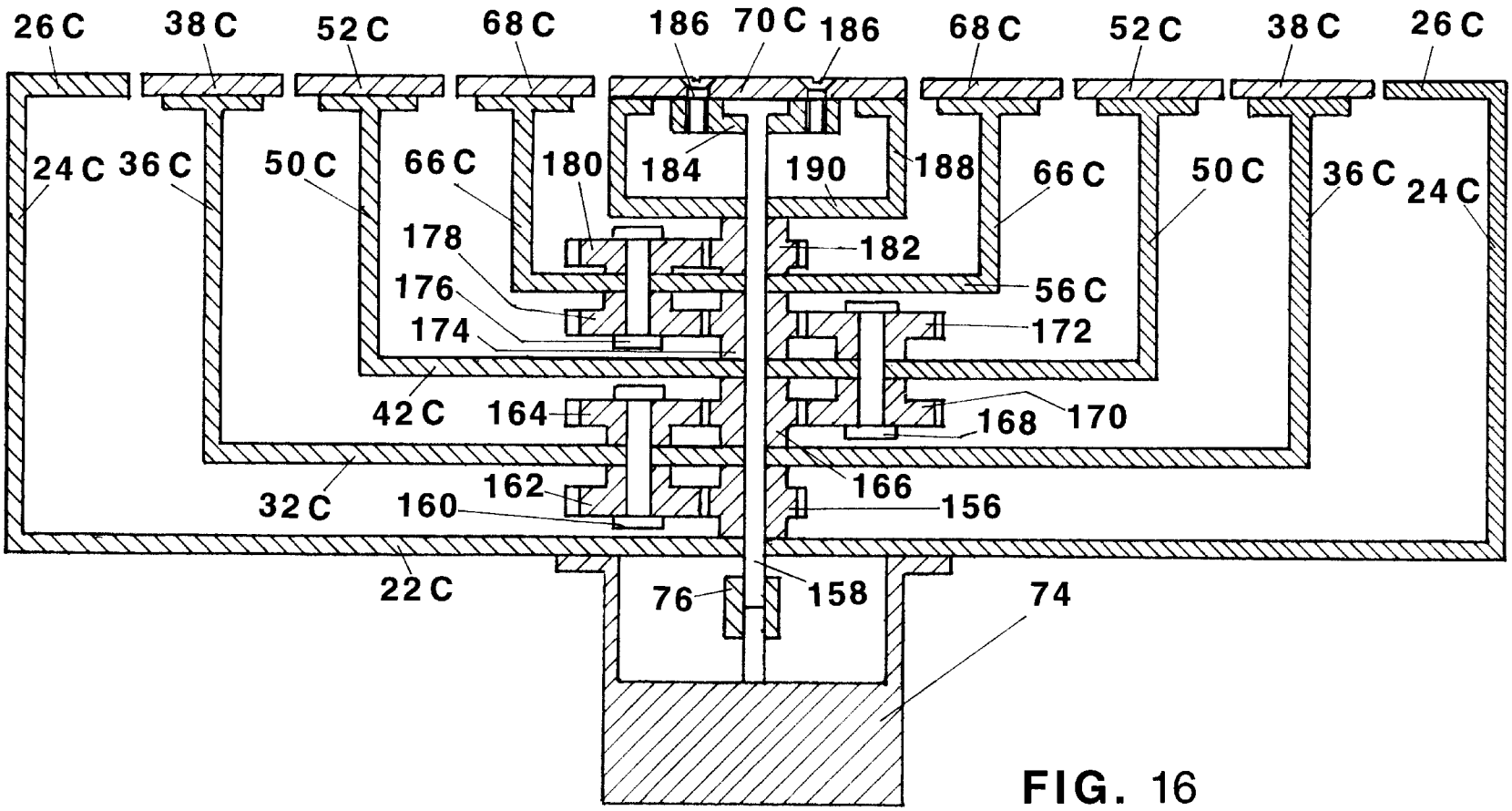
FIG. 16 is a sectional view through FIG. 15.

FIGS. 15 & 16 show a five layer system in the concentric mode. The first layer is stationary and contains a fixed gear 156 only, mounted on the side of a plate 22C nearest the second layer, with bracket 24C, supporting a stationary segment 26C.

The second layer is rotated by a drive shaft 158 concentric with fixed gear 156 on the first layer, and passing through it. Shaft 158 is secured to a plate 32C, with bracket 36C, supporting a rotating segment 38C. The second layer also contains a transfer gear assembly, consisting of a transfer gear 162, fastened to a pin 160, which in turn is fastened to a transfer gear 164. Pin 160 rotates freely in plate 32C. Transfer gear 162 meshes with fixed gear 156 and transfer gear 164 meshes with a fixed gear 166 on the third layer.

Fixed gear 166 is attached to the side of a plate 42C nearest the second layer, and is concentric with shaft 158. Plate 42C supports a bracket 50C, supporting a rotating segment 52C. Plate 42C also contains a transfer gear assembly, consisting of a transfer gear 170, fastened to a pin 168, which in turn is fastened to a transfer gear 172. Pin 168 rotates freely in plate 42C. Transfer gear 170 meshes with fixed gear 166 and transfer gear 172 meshes with a fixed gear 174 on the fourth layer.

Fixed gear 174 is attached to the side of a plate 56C nearest the third layer, and is concentric with shaft 158. Plate 56C supports a bracket 66C, supporting a rotating segment 68C. Plate 56C also contains a transfer gear assembly, consisting of a transfer gear 178, fastened to a pin 176, which in turn is fastened to a transfer gear 180. Pin 176 rotates freely in plate 56C. Transfer gear 178 meshes with fixed gear 174 and transfer gear 180 meshes with a fixed gear 182 on the fifth layer.

Fixed gear 182 is attached to the side of a plate 190 nearest the fourth layer, and is concentric with shaft 158. Plate 190 supports a bracket 188, supporting a rotating segment 70C. Plate 190 is concentric to shaft 158 and contains a retainer 184. Retainer 184 is secured to plate 190 by means of a screw 186 (multiple). Shaft 158 rotates freely within the confines created by plate 190 and retainer 184. Shaft 158 is driven by motor 74 through coupling 76.

The device, in FIG. 17 and FIG. 18, showing the overlapping segment mode, is driven by the same mechanism that drives the eccentric nested device, described referring to FIGS. 1 and 2.

Bracket 36 is replaced by a bracket 192, which is longer, bracket 50 is replaced by a bracket 194, which is longer, bracket 66 is replaced by a bracket 196, which is longer, and projecting shaft 62 is replaced by a projecting shaft 198, which is longer; all are elongated to accommodate the overlapping. Rotating segment 38 is replaced by a rotating segment 200, Rotating segment 52 is replaced by a rotating segment 202, rotating segment 68 is replaced by a rotating segment 204, and rotating segment 70 is replaced by a rotating segment 206.

Figure 19:
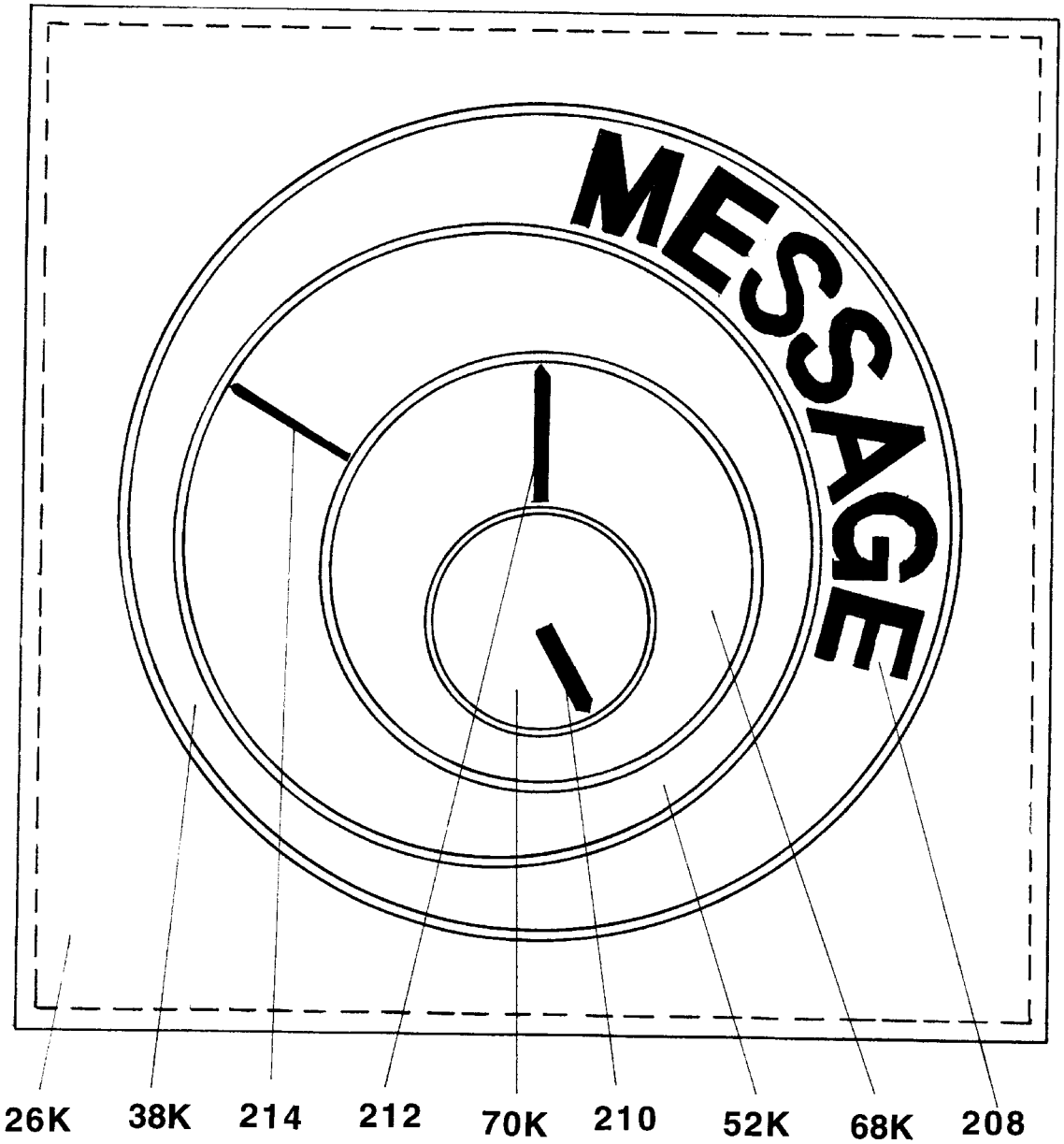
FIG. 19 is an elevation view of the display device used as a clock.

FIG. 19 shows the display device used as a clock. A stationary segment 26K, which is part of the frame or housing, can carry a message or design, if desired. A rotating segment 38K, can also carry a message 208, or design, and can rotate either clockwise or counter-clockwise as desired. A rotating segment 52K, rotating clockwise, carries a second marker 214. A rotating segment 68K, rotating clockwise, carries a minute marker 212. A rotating segment 70K, rotating clockwise, carries a hour marker 210.

I claim:

1. A planetary display device comprising in combination:

a) a group of at least three plates, specifically a first plate, at least one intermediate plate, and a last plate; said group of plates are located parallel to one another, approximately equally spaced, one in front of each other, said first plate being positioned behind said group of plates, each plate of said at least one intermediate plate and said last plate being of predetermined length and having a front side and a back side; said first plate having a primary hole located at it center longitudinally, perpendicular to said front side of said first plate; each said at least one intermediate plate having one primary hole located at its approximate center longitudinally, perpendicular to its said front side; each said at least one intermediate plate having one secondary hole located at a predetermined distance from its said primary hole, perpendicular to its said front side; each said at least one intermediate plate having one intermediate drive shaft fastened in its said secondary hole and projecting perpendicularly from its said back side; said last plate having a center hole located at its center longitudinally, perpendicular to said front side of said last plate, said last plate having a last drive shaft fastened at its said center hole and projecting perpendicularly from its said back side; each said intermediate drive shaft and said last drive shaft going through and rotating freely in each said primary hole directly behind it in this said group of plates;

b) a motor, said motor fixed to said back side of said first plate, said motor having shaft, attached, by means of a coupling to said intermediate drive shaft projecting from said back side of said at least one intermediate plate closest to said first plate and passing through said first plate, rotating said at least one intermediate plate closest to aid first plate, at a predetermined speed and direction of rotation;

c) a group of planetary systems, one said planetary system for each said at least one intermediate plate used; each of said planetary systems, consisting of a fixed mechanical element, a driver, and a driven mechanical element, selected and functionally assembled to attain predetermined speed ratios and direction of rotation; said fixed mechanical elements are attached to and aligned with said primary holes in each said plates at said front side thereof said except for the most forwardly positioned said at least one intermediate plate and said last plate; said drivers are formed by that part of each said at least one intermediate plate between said primary holes and said secondary holes; said driven mechanical elements are fastened to projecting ends of said last drive shaft and each said intermediate drive shaft except the said intermediate drive shaft connected by means of said coupling to said motor shaft;

d. a group of segments, equal in number to said group of plates, each of said group of segments being of a predetermined size and shape, each of said group of segments being fastened by means of a set of brackets to periphery of each of said group of plates; each said set of brackets being adequate for rigidity and predetermined position of each of said group of segments; each of said set of brackets, being of a predetermined length; during motion generated by said motor and said group of planetary systems, predetermined spatial relationships of said group of segments, to each other, are attained without interference; each of said set of segments being rotated and orbited, except said segment attached to said first plate being fixed, and said segment, attached to said at least one intermediate plate immediately in front of said first plate, being rotated only;

e. a group of partial messages equal in number to said group of segments, each of said group of partial messages being displayed on front, exposed surface of each of said group of segments; in any one predetermined position of all said group of segment, said group of partial messages transmits an unscrambled and readable message; in any other position of all of said group of segments, said group of partial messages transmits a scrambled and unreadable message; said group of partial messages is being scrambled and unscrambled in a cyclical manner.

* * * * *